US005751307A

United States Patent [19]

Paroff et al.

[11] Patent Number: 5,751,307

[45] Date of Patent: May 12, 1998

[54] PRINT CARTRIDGE CLEANING APPARATUS AND METHOD USING WATER AND AIR

[75] Inventors: Paul J. Paroff, E. Amherst; Orrin D. Christy, North Tonawanda; James M. Schweitzer, Lancaster; Mark A. Matheis, North Tonawanda, all of N.Y.,

[73] Assignee: Moore Business Forms, Inc., Grand Island, N.Y.

[21] Appl. No.: 226,685

[22] Filed: Apr. 12, 1994

[51] Int. Cl.[6] ..... B41J 2/45; B41J 2/47; B08B 3/00; A47L 5/00

[52] U.S. Cl. ..... 347/33; 347/34; 134/64 R; 134/122 R; 134/49; 15/309.2

[58] Field of Search ..... 134/64 R, 122 R, 134/44, 49, 199; 15/309.2, 306.1, 309.1; 347/33, 34, 28, 21, 30, 27

[56] References Cited

U.S. PATENT DOCUMENTS

| | | | |
|---|---|---|---|
| 3,801,387 | 4/1974 | Goffredo et al. | 216/92 |
| 4,129,919 | 12/1978 | Fitch et al. | 15/302 |
| 4,325,746 | 4/1982 | Popplewell et al. | 134/64 |
| 4,340,897 | 7/1982 | Miller | 347/33 |
| 4,401,990 | 8/1983 | Aiba et al. | 347/33 |
| 4,528,996 | 7/1985 | Jones | 347/28 |
| 4,554,062 | 11/1985 | Sergio | 204/202 |
| 4,589,926 | 5/1986 | Holmstrand | 15/302 |
| 4,591,870 | 5/1986 | Braun et al. | 347/28 |
| 4,591,873 | 5/1986 | McCann et al. | 347/21 |
| 4,600,928 | 7/1986 | Braun et al. | 347/74 |
| 4,746,938 | 5/1988 | Yamamori et al. | 347/28 |
| 4,791,437 | 12/1988 | Accattino et al. | 347/28 |
| 4,849,769 | 7/1989 | Dressler | 347/27 |
| 4,853,717 | 8/1989 | Harmon et al. | 347/33 |
| 4,875,054 | 10/1989 | Archer et al. | 347/21 |
| 4,881,085 | 11/1989 | Gibson et al. | 347/30 |
| 4,920,603 | 5/1990 | Keim et al. | 134/64 |
| 4,985,111 | 1/1991 | Ketelhohn | 216/92 |
| 5,056,948 | 10/1991 | Puder et al. | 401/143 |
| 5,063,951 | 11/1991 | Bard et al. | 134/64 R |
| 5,115,250 | 5/1992 | Harmon et al. | 347/33 |
| 5,151,715 | 9/1992 | Ward et al. | 347/33 |
| 5,184,147 | 2/1993 | MacLane et al. | 347/33 |

FOREIGN PATENT DOCUMENTS

| | | | |
|---|---|---|---|
| 56-152239 | 11/1981 | Japan | 134/64 |

*Primary Examiner*—Benjamin R. Fuller
*Assistant Examiner*—Raquel Yvette Gordon
*Attorney, Agent, or Firm*—Nixon & Vanderhye P.C.

[57] ABSTRACT

Print cartridges for ion/electron deposition printing are periodically cleaned to provide preventive maintenance, using a simple cleaning assembly that automatically moves the cartridges first past a water washing nozzle, and then past an air drying nozzle, at slow speed, then being manually withdrawn from the cleaning assembly and replaced in the printer. The drive mechanism typically is a single roller disposed above the print cartridge, driven by a motor connected to the housing. A single water spray nozzle is disposed at an intermediate portion of the housing directed with a fan pattern spray up toward the cartridge, and a single air nozzle supplied with heated air is disposed adjacent the outlet of the cartridge. Sensing of the position of the cartridge is provided by first through fourth in-line microswitches which are disposed above the cartridge and which are cam actuated by the cartridge as it moves through the housing to control the motor driving the roller, the pump supplying water to the water nozzle, and a solenoid valve connecting the air nozzle to a source of compressed air. The cartridges are cleaned every 10,000–30,000 feet of use, and then replaced.

25 Claims, 5 Drawing Sheets

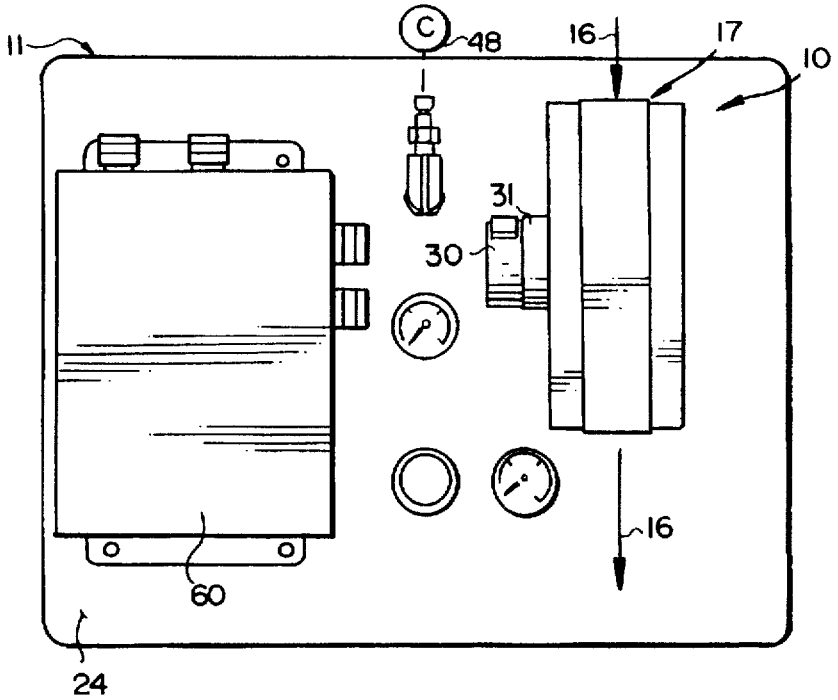
Fig.5
Fig.6
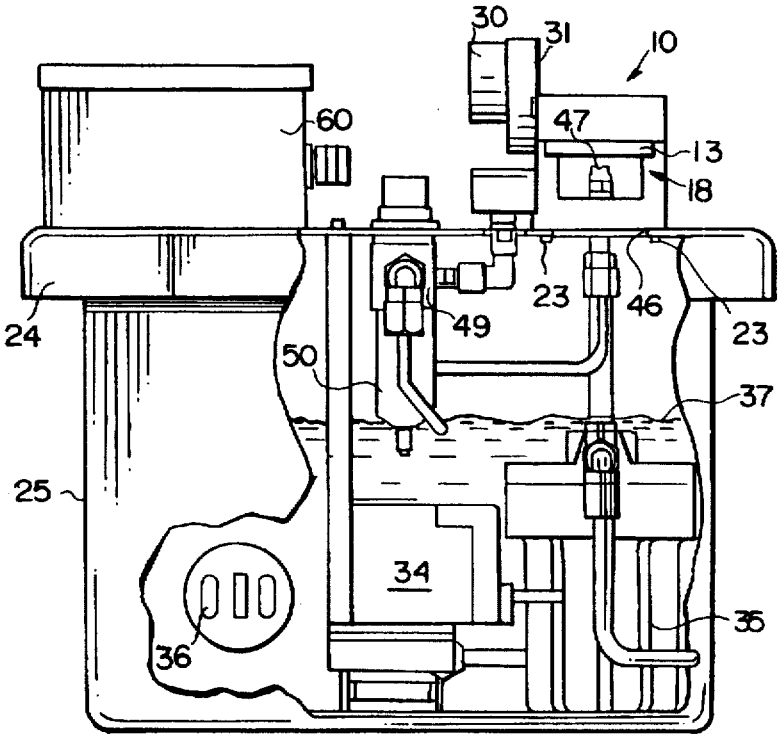

PRINT CARTRIDGE CLEANING APPARATUS AND METHOD USING WATER AND AIR

BACKGROUND AND SUMMARY OF THE INVENTION

Print cartridges, such are as used with the MIDAX ion print system, or with other types of ion deposition and/or electron deposition imaging systems, typically have a useful life of about 150,000 feet (that is feet of printed material). However the useful life can be doubled, e.g. to about 300,000 feet, on average, by preventive maintenance techniques, removing the cartridges from the printer and washing them with hot water every 10,000–30,000 feet of use.

In order to effectively wash the cartridges, it is desirable to use a simple, compact, yet efficient cleaning assembly. In the past, the commercially utilized washing system included a modular cabinet having a rinsing station consisting of nine water jets, an air/vacuum unit, an oven/sealer portion, and an acid cleaning station. Water at a temperature of between 130°–180° F. at a pressure of about 25 psi was sprayed for approximately one to seven minutes on the cartridges, the nozzle pattern ranging from 45°–90° and the flow being about 0.8 gallons per minute. The cartridge was then manually moved up and down within the air/vac unit, providing airflow for drying the cartridge. The oven was then used for final drying of the cartridge for approximately fifteen minutes at a temperature of about 130° F. If the acid washing station was used, the above procedure was followed again. While this system worked to effect cleaning, the acid wash was typically undesirable and the cleaning labor intensive.

According to the present invention a cartridge cleaning assembly is provided which overcomes the drawbacks associated with the prior art system. The cleaning assembly according to the present invention is the epitome of simplicity, having a minimum number of components, yet is essentially automatic, moving the print cartridge through the cleaning assembly to effect a cleaning cycle, and completely stopping once the cartridge is manually removed from the housing. Despite the minimum number of components, the cleaning system effectively cleans print cartridges, and also effectively dries them, with a minimum energy use, and time, and with a high degree of safety.

According to one aspect of the present invention, a cartridge cleaning assembly is provided comprising the following elements: A housing having an inlet, outlet, and straight line path between the inlet and outlet. Drive means for driving a cartridge in the straight line path from the inlet to the outlet. A water spray nozzle located within the housing between the inlet and outlet and directed toward the straight line path. An air spray nozzle located within the housing adjacent the outlet and directed toward the straight line path. And, sensing means disposed within the housing and automatically operating the drive means, water spray nozzle, and air spray nozzle in response to the position of a cartridge within the housing.

The air nozzle is typically disposed at a portion of the housing open to atmosphere, and is supplied with filtered, heated (e.g. to about 100°–140° F.) air. A single air nozzle is provided disposed below the straight line path, and a single water nozzle is also provided, directing a fan spray upwardly to the cartridge travelling in the straight line path. The water nozzle is supplied with heated water (e.g. between 120°–180° F.) under pressure (e.g. about 20 psi), with a water flow delivery of 0.5–2.0 gpm (typically about 1 gpm).

The assembly is typically mounted on the cover of an open top tank, and a heating element for the water, the water pump, a solenoid valve for supplying air under pressure from an external compressor to the air nozzle, an air heater, and air and water filters are provided in the tank. Water drains from the housing through the cover into the open top of the tank so that it is constantly recirculated.

The sensing means preferably comprise a plurality of microswitches disposed in the straight line path above the straight line path. Typically first through fourth microswitches are provided, the first and third switches (in the direction from the inlet to the outlet) for starting the pump, the second and third for starting and stopping the motor which drives the drive means, and the second and fourth for operating the solenoid valve. The drive means preferably comprises a single drive roller disposed above the straight line path and having a resilient surface which engages the top of the cartridge, the motor for driving the roller mounted directly on the housing. A pair of guide rollers are preferably provided beneath the straight line path on opposite sides of the water nozzle, with silicone rubber guide belts straddling the water nozzle and extending between the guide rollers.

According to another aspect of the present invention, a cartridge cleaning assembly for cleaning generally flat, elongated ion/electron deposition print cartridges having a length in the dimension of elongation, and a width perpendicular to the dimension of elongation, comprises the following elements: A housing having an inlet, outlet, and a straight line path between the inlet and outlet, with spacing between the inlet and outlet in the straight line path being much less than the length of the print cartridge, and the housing having a width greater than the width of the print cartridge. A water spray nozzle mounted in the housing between the inlet and outlet below the straight line path. An air nozzle adjacent the outlet below the straight line path. And, means for guiding a print cartridge along the straight line path between the inlet and outlet. The components of the assembly are as specifically described above.

The invention also comprises a method of maintaining ion/electron deposition print cartridges using a cleaning system comprising a housing having an inlet, outlet, drive mechanism for driving the cartridge from the inlet to the outlet, a water nozzle supplied with water from a pump, an air nozzle, and sensors for sensing the position of the cartridge in the housing. The method comprises the following steps: (a) Every 10,000–30,000 feet of use of the cartridge, removing it from the printer and manually feeding the ion/electron deposition printer cartridge into the housing inlet. (b) Automatically, responsive to the feeding step (a), sensing the penetration of the cartridge into the housing to a first position, and initiating operation of the water nozzle pump and the drive mechanism. (c) After step (b), automatically driving the cartridge through the housing with the drive mechanism from the inlet toward the outlet in the drive path, while spraying the cartridge with water from the water nozzle. (d) Automatically sensing penetration of the cartridge to a second position within the housing, closer to the outlet than the first position, and then initiating operation of the air nozzle. (e) After step (d), while the cartridge is being driven through the housing downstream of the water nozzle in the drive path, directing gas from the air nozzle onto the cartridge to dry the cartridge. (f) Automatically sensing penetration of the cartridge past the water nozzle so that the trailing end thereof stops operation of the pump while allowing the cartridge to continue to be driven through the system. (g) After step (f), continuing to advance the cartridge while drying continues until the cartridge trailing end moves past a sensor close to the end of the housing at which time operations of the drive mechanism and the air nozzle are terminated. (h) After step (g), manually withdrawing the print cartridge from the housing. And, (i) after step (h), replacing the print cartridge in the printer.

Step (c) is practiced to spray water at a temperature between 120°–180° F. onto the cartridge at a pressure of about 20 psi, directed at an angle of between about 30°–45° to the drive path. The water spray is preferably a fan pattern from a single nozzle, the water being delivered at a rate of between 0.5–2.0 gallons per minute, with the fan orthogonal to the diagonal finger electrodes. Step (e) is practiced by directing the filtered air at a temperature of between 100°–140° F. at a pressure of about 10–30 psi onto the cartridge from a single nozzle disposed below the cartridge, and steps (b) through (e) are typically practiced by driving the cartridge slowly, e.g. at a speed of about 9 inches per minute.

It is the primary object of the present invention to provide for the simple yet effective semi-automatic cleaning of ion/electron deposition print cartridges. This and other objects of the invention will become clear from an inspection of the detailed description of the invention, and from the appended claims.

BRIEF DESCRIPTION OF THE DRAWINGS

FIG. 5 is a top view of the assembly of FIGS. I through 4 mounted on the cover of a tank;

FIG. 6 is a side view, with portions of the tank wall cut away for clarity of illustration, of the apparatus of FIG. 5.

DETAILED DESCRIPTION OF THE DRAWINGS

Figure 1:
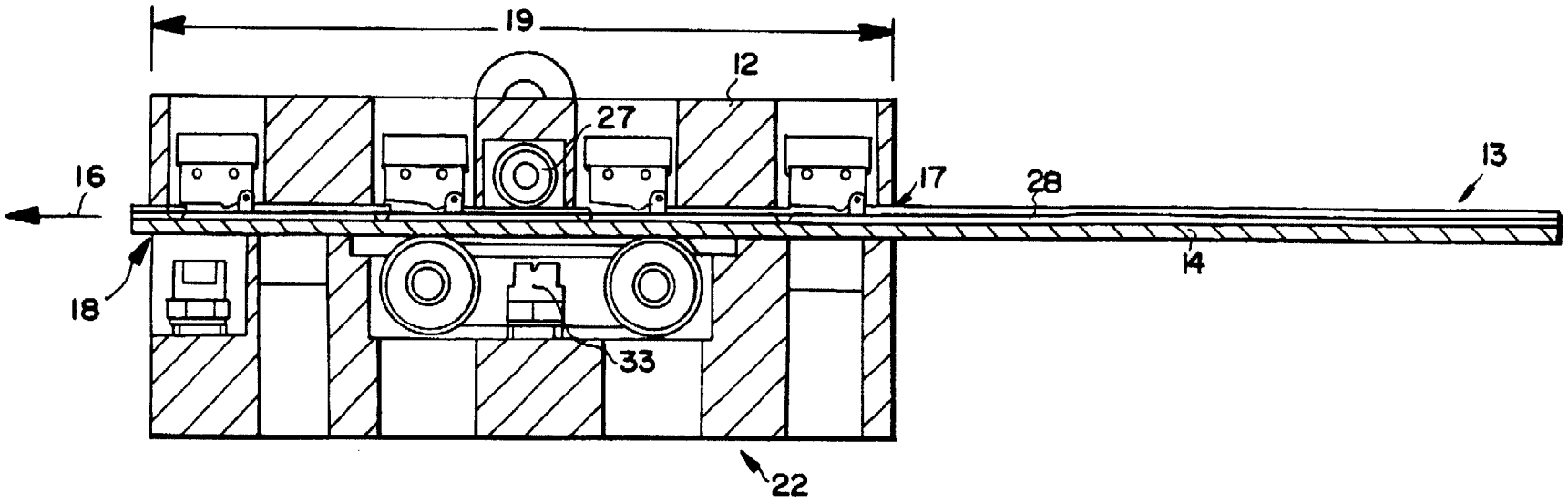
FIG. 1 is a side view, partly in cross-section and partly in elevation, of an exemplary cartridge cleaning assembly according to the invention showing a print cartridge being driven therethrough.

A cleaning assembly 10 according to the present invention is seen in different views in FIGS. 1 through 6, and shown mounted on a tank 11 having components supplying cleaning and drying fluids thereto in FIGS. 5 and 6. The assembly 10 includes a housing, shown generally by reference numeral 12, typically made of ultra high molecular weight plastic, such as polytetrafluoroethylene, which provides minimum friction between housing 12 components and a substantially planar cartridge 13 (see FIGS. 1 and 2) which the assembly 10 is used to clean. The print cartridge 13 is typically a MIDAX ion cartridge having diagonal finger electrodes accessible from the face 14 thereof, but in the practice of the invention any ion/electron deposition imaging (print) system cartridge may be cleaned.

The cartridge 13 has a length in the direction 16—which is the direction of the path of movement of the cartridge 13 between the housing 12 inlet 17 and outlet 18—which is significantly greater than the length 19 of the housing 12 in the direction 16. From the inlet 17 to the outlet 18, the cartridge 13 passes in a straight line path along direction 16, the straight line path being indicated at dotted line 20 in FIGS. 2 through 4. The housing 12 has a greater width (the direction perpendicular to the length 19) than the cartridge 13, however, as seen in FIG. 6, the width of the inlet 17 and outlet 18 being slightly greater than the width of the cartridge 13.

Figure 2:
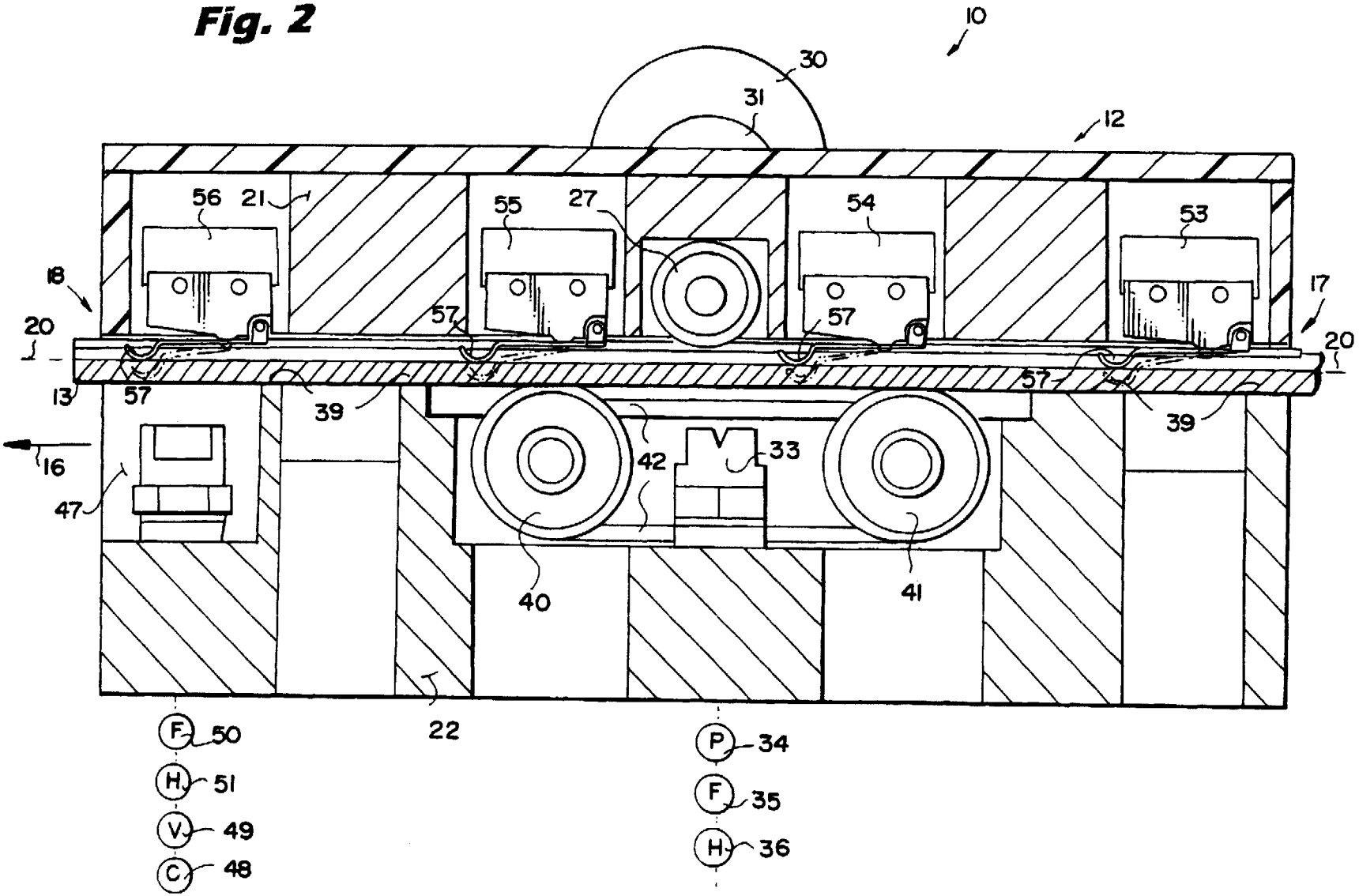
FIG. 2 is an enlarged version of FIG. 1, with the cartridge cut off for clarity of illustration, and schematically showing a number of components cooperating with the assembly.

The housing 12 may be constructed of top and bottom sections as seen in FIG. 2 at 21, 22 connected together at the corners thereof, outside the widths of the inlet 17 and outlet 18, by screws (not shown). The housing 12 also is preferably mounted by screws (e.g. 23 in FIG. 6) to the removable cover 24 of tank 11, the cover 24 normally covering the open top of the tank bottom 25.

Figure 3:
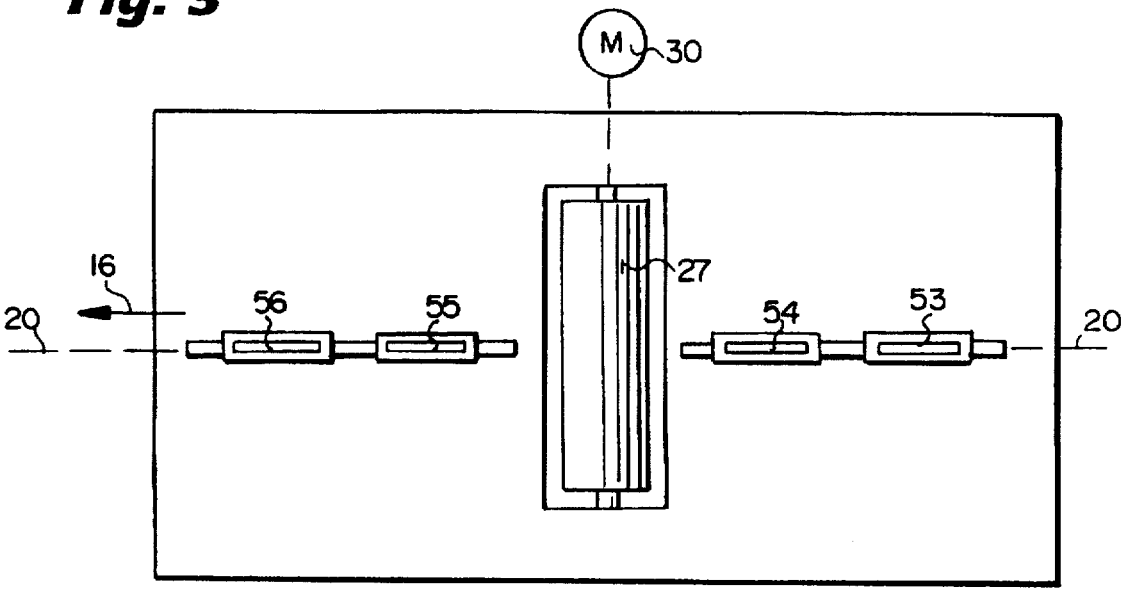
FIG. 3 is a top schematic view of the assembly of FIG. 1 primarily illustrating the drive roller and the alignment of the microswitches.

As seen most clearly in FIGS. 1 through 3, the assembly 10 further comprises drive means for automatically driving the cartridge 13 in direction 16 through the housing 12 at a slow speed (e.g. about 9 inches per minute). The drive means preferably consists of a single drive roller 27 mounted above the cartridge 13, and the straight line path 20, engaging the top surface 28 of the cartridge 13. The roller 27 is driven by an electric motor 30 through reduction gearing in housing 31. The housing 31 and motor 30 may be to mounted directly to the top half 21 of the housing 12, as seen most clearly in FIGS. 2, 5, and 6. The roller 27 may have an outer surface of, or be constructed of, silicone rubber for resilience, flexibility, and chemical resistance, and will not damage the cartridge 13.

The assembly 10 also comprises a water spray nozzle 33. Preferably a single nozzle 33 is provided disposed in a central portion of the housing 12 mounted by housing bottom 22, below the straight line path 20, and directed upwardly toward the path 20 (and the cartridge 13 moving in path 20) as seen most clearly in FIGS. 1 and 2. The nozzle 33 typically is a fan pattern spray nozzle directed at an orientation of about 30°–45°, oriented orthogonal to the diagonal finger electrodes of the cartridge 13. This optimizes the cross flow of water which rinses out debris and contaminants by flowing in and out of all holes of each of the finger electrodes of cartridge 13. The nozzle 33 may be of the type that is screwed into a fixed space and rotated to an optimum orientation, but typically is preset in the optimum orientation when the assembly 10 is constructed.

Figure 7:
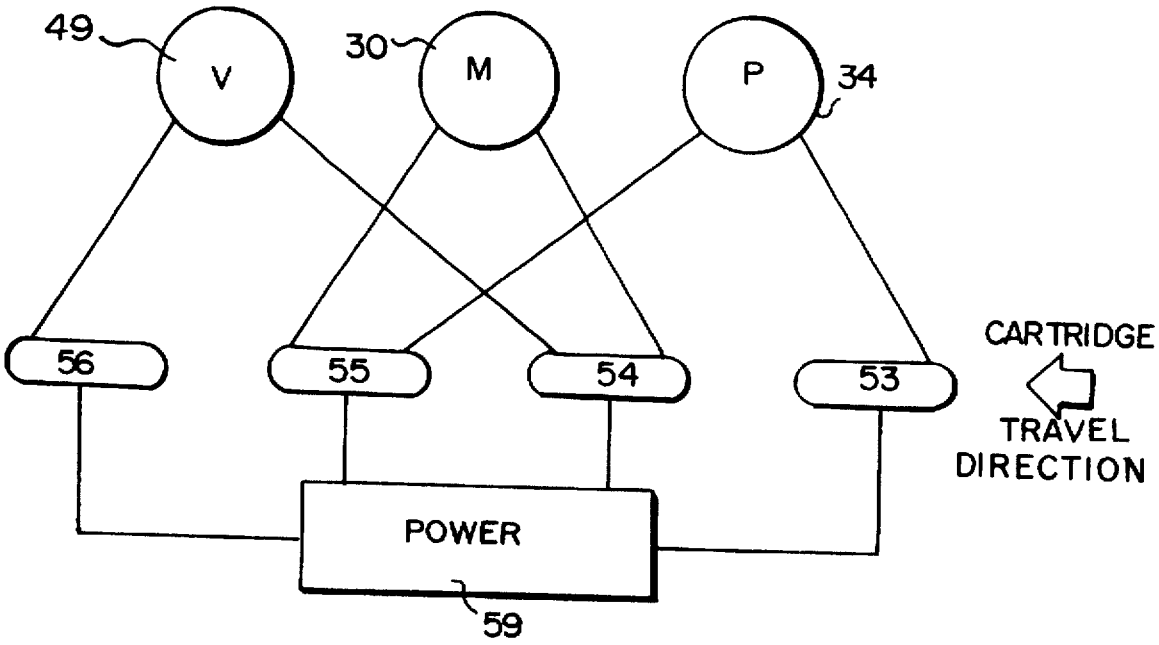
FIG. 7 is an electrical schematic showing the interconnection between various electrical components of the assembly of FIGS. 2, 5, and 6.

The nozzle 33 is supplied water under pressure (e.g. 10–30 psi, preferably about 20 psi) from a pump 34 (see FIGS. 2, 6, and 7) mounted within the tank bottom 25. The water being pumped—either before entering pump 34 or after the pump 34—passes through a filter 35, such as an Ametek, Inc. (Sheboygan, Wis.) five micron filter, part no. 158003. The water is also heated, by the water heating electrical element 36 (see FIG. 6) mounted in the tank bottom 25 below the level of water that typically is provided therein, the water level illustrated schematically at 37 in FIG. 6. The water is typically heated to 120°–180° F., with about 150° F. being optimum, and is typically supplied at a flow rate of about one gallon per minute (e.g. between 0.5–2 gpm), through the single nozzle 33.

Also associated with the assembly 10 are guide means for guiding the cartridge 13 as it moves in the direction 16. While various surfaces of the housing 12, particularly upper surfaces of the housing 22 (e.g. see surfaces 39 in FIG. 2 for example), provide some guiding action, guiding is also preferably provided by first and second guide rollers 40, 41

Figure 4:
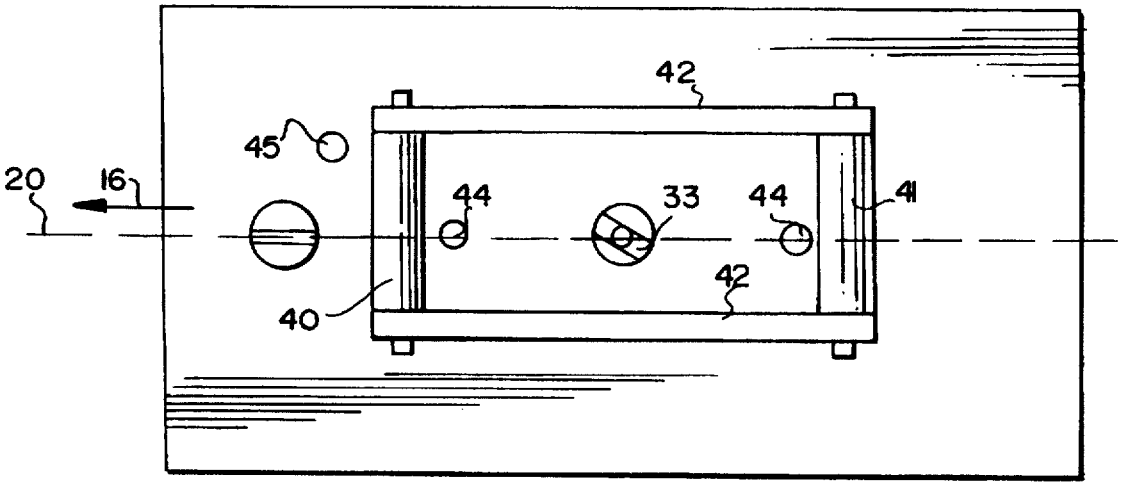
FIG. 4 is a schematic view showing the assembly of FIGS. 1 and 2 with the top of the housing component removed.

(see FIGS. 1, 2, and 4 in particular) which are disposed on opposite sides of the nozzle 33 in the direction 16, and which have a pair of guide belts 42 wrapped around them, the guide belts 42 straddling the nozzle 33 as seen most clearly in FIG. 4. The rollers 40, 41 (at the surfaces thereof) and the belts 42 are preferably formed of silicone rubber for resilience, flexibility, and chemical resistance, the guide rollers 40, 41 and the belts 42 providing a moving seal which minimizes the lateral stresses applied to the relatively delicate laminated face 14 of the cartridge 13.

Also provided in the housing bottom 22, on either side of the water nozzle 33, are the drain openings 44, at least two such drain openings being provided, and typically others, such as the opening 45, and others not shown in the drawings. Those openings 44, 45 pass not only through the housing bottom 22, but through the opening 46 (see FIG. 6) in the cover 24, to be recirculated by the pump 34, and heated by the heater 36, and filtered by the filter 35.

Downstream of the guide roller 40 in the direction 16 is an air nozzle 47, which is mounted in the housing 12, but adjacent the outlet 18, and in fact open to the atmosphere at the outlet end of the housing 12, as seen in both FIGS. 2 and 6. Typically only a single air nozzle 47 is provided mounted in the housing bottom 22 directed upwardly toward the path 20 and cartridge 13 moving therein, and the air nozzle 47 is provided with air under pressure from a compressor 48 (see FIGS. 2 and 5) located exteriorly of the tank 11. The pressure of air supplied to the nozzle 47 is preferably 10–30 psi, with about 20 psi being optimum. The air passes through a solenoid controlled valve 49, and air is preferably filtered by a conventional air filter 50. While ambient air may be suitable, preferably the air is also heated to a temperature of about 100°–140° F., e.g. using a conventional air heater 51, before it passes through the nozzle 47.

The assembly 10 also comprises sensing means disposed within the housing 12 and automatically operating the drive roll 27 motor 30, the water spray nozzle 33 (by operating the pump 34), and the air nozzle 47 (by operating solenoid valve 49), in response to the position of the cartridge 13 within the housing 12. The sensing means preferably take the form of a plurality of microswitches, such as the first microswitch 53, second microswitch 54, third microswitch 55, and fourth microswitch 56 which are mounted preferably in a straight line along straight line path 20 as illustrated most clearly in FIG. 3. The microswitches 53, 54 are mounted toward the inlet 17 side of the water nozzle 33, while the microswitches 55, 56 are mounted toward the outlet side 18 of the water nozzle 33. As typical for microswitches, the microswitches 53–56 are each operated by an actuator 57 (see FIG. 2). The microswitches 53–56 may be of any water-resistant type suitable for this purpose, such as those available from Aromat Corporation of New Providence, N.J., model no. ABS 161 4509. The actuators 57 are cammed up by the print cartridge 13 as it moves in the direction 16, and after the trailing end of the print cartridge 13 moves past an actuator 57, the actuator 57 drops back down.

The switches 53–56 are typically connected to a power source 59 (see FIG. 7) in the electronics box 60 mounted on the cover 24 (see FIGS. 5 and 6) and are designed so that they control the motor 30, pump 34, and solenoid valve 49 to effect the desired cleaning operation of the print cartridges 13. Preferably all of the components associated with box 60 and tank 11 that are electrical are quick connect and disconnect couplings for ease and modularity of service.

An exemplary method of cleaning a print cartridge 13, which is removed from a MIDAX printer or the like every 10,000–30,000 feet of use thereof, is as follows:

With the diagonal finger electrode surface 14 of the print cartridge 13 facing downwardly, the operator manually moves the leading edge of the print cartridge 13 through the inlet 17, the entire operative components of the assembly 10 being "off" at that point. As the print cartridge 13 is guided on the low friction surfaces 39, it cams upwardly the actuators 57 of the first, second and third microswitches 53, 54, 55 turning on pump 34 and causing water to issue upwardly through the nozzle 33, and actuating drive motor 30, while also engaging the guide rolls 40, 41 and the guide belts 42. As the print cartridge 13 is further manually moved in the direction 16 it cams upwardly the actuator 57 for the second microswitch 54, while also engaging the guide rolls 40, 41, and the guide belts 42. The switch 54 opens the solenoid valve 49, causing the heated filtered air from the compressor 48 to issue upwardly through the air nozzle 47. Once the cartridge 13 engages microswitch 55, the operator no longer provides a pushing force, but rather the roller 27 drives the cartridge 13 slowly through the housing 12 in the direction 16, camming up the actuator 57 for the switch 56. The heated filtered water from nozzle 33 cleans the debris from the print cartridge 13, while the heated filtered air from air nozzle 47 dries the cartridge 13, as it is continuously slowly moved in the direction 16 by the roller 27.

Once the cartridge 13 has advanced far enough through the housing 12 so that the trailing edge of cartridge 13 passes past switch 53 causing the actuator 57 thereof to move downwardly the pump 34 which supplies water to the nozzle 33 is turned off. As the cartridge 13 further advances through the housing 12 so that the trailing edge of cartridge 13 passes past switch 54 causing the actuator 57 thereof to move downwardly the drive motor 30 and the solenoid valve 49 are turned off. At this point the washing and drying process is complete and the operator may then manually remove the cartridge 13 from the housing 12.

The method steps may be continued from a first to a last cartridge by moving cartridges in series, one after the other (and touching) into the housing 12. In that case an operator must be available to support and carefully remove each cartridge 13 when discharged from housing 12 by the roller 27 driving the following cartridge 13 in engagement with it.

It will thus be seen that according to the present invention a simple yet advantageous cartridge cleaning assembly has been provided, which can be utilized—long with the method of preventive maintenance according to the invention—to double the printing life of many ion/electron deposition print is cartridges. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent assemblies and methods.

What is claimed is:

1. A cartridge cleaning assembly for cartridges having a first surface and a second surface, opposite to the first, and wherein the first surface has components easily damaged by contact with other solid materials and opposite edges extending beyond the components said assembly comprising:

a housing having an inlet, outlet, and a straight line cartridge path between the inlet and outlet, said housing having guide surfaces adjacent the cartridge path and aligned with the opposite edges of the first surface of the cartridge as the cartridge moves alone the cartridge path, and said cartridge path has an open space extending from the inlet to the outlet aligned with the components on the first surface to allow the components to pass through the housing without contacting other solid materials;

drive means for driving the cartridge in said straight line path from the inlet to the outlet, wherein said drive means engages the second surface of the cartridge;

a water spray nozzle located within said housing between said inlet and outlet, and directed toward said straight line cartridge path, and said water spray nozzle directing a water spray onto the first surface of the cartridge moving along the cartridge path;

an air spray nozzle located within said housing adjacent said outlet and directed toward said straight line path, and said air spray nozzle directing air onto the first surface of the cartridge;

sensing means disposed within said housing and automatically operating said drive means, water spray nozzle, and air spray nozzle in response to the position of a cartridge within said housing.

2. An assembly as recited in claim 1 wherein said air nozzle adjacent said outlet is disposed in a portion of said housing open to the atmosphere.

3. An assembly as recited in claim 1 wherein said air nozzle is the only air nozzle of said assembly, and wherein said air nozzle is supplied with filtered air under superatmospheric pressure.

4. An assembly as recited in claim 3 wherein said water nozzle is the only water nozzle of said assembly, and is supplied with heated water under superatmospheric pressure.

5. An assembly as recited in claim 1 wherein said water nozzle is the only water nozzle of said assembly, and is supplied with heated water under superatmospheric pressure.

6. An assembly as recited in claim 1 wherein said sensing means comprise a plurality of microswitches disposed in said straight line path.

7. An assembly as recited in claim 6 further comprising a water pump connected to said water nozzle, an air solenoid valve connected to said air nozzle, and a drive motor connected to said drive means; and wherein said plurality of microswitches comprises first and third switches for initiating and terminating operation of said pump; second and third switches for initiating and terminating operation of said drive motor; and second and fourth switches for initiating and terminating operation of said solenoid valve.

8. An assembly as recited in claim 7 wherein said first and second switches are between said inlet and said water nozzle, and said third and fourth switches are between said water nozzle and said outlet.

9. An assembly as recited in claim 8 wherein said microswitches are disposed above said straight line path, and said water and air nozzles are disposed below said straight line path.

10. An assembly as recited in claim 9 wherein said housing is mounted on the cover of a tank, said tank including a water heating element, said pump, said solenoid valve, and air and water filters; and further comprising drain openings extending through said housing and said tank cover into said tank.

11. An assembly as recited in claim 4 further comprising first and second guide rollers mounted below said straight line path, one on either side of said water nozzle in said straight line path, with guide belts extending between said guide rollers straddling said water nozzle.

12. An assembly as recited in claim 5 further comprising first and second guide rollers mounted below said straight line path, one on either side of said water nozzle in said straight line path, with guide belts extending between said guide rollers straddling said water nozzle.

13. A cleaning assembly for cleaning generally flat, elongated print cartridges of one of ion deposition and electron deposition imaging systems wherein the cartridges have a surface, and having a length in a dimension of elongation, and a width perpendicular to the dimension of elongation, comprising:

a housing having an inlet, outlet, and a straight line path between said inlet and outlet, with spacing between said inlet and outlet in said straight line path being much less than the length of a print cartridge, and said housing having a width greater than a width of the print cartridge;

a water spray nozzle mounted in the housing between said inlet and outlet below said straight line path, an air nozzle adjacent said outlet below said straight line path; and means for guiding a print cartridge along said straight line path between said inlet and outlet without contacting a center area of the surface of print cartridge with solid materials as the surface is cleaned.

14. An assembly as recited in claim 13 further comprising drive means for driving a print cartridge in said straight line path from said inlet to said outlet.

15. An assembly as recited in claim 14 wherein said drive means comprise a motor mounted on said housing and a single roller mounted above said straight line path, over said water nozzle, and having a resilient surface for engaging the print cartridge.

16. An assembly as recited in claim 13 wherein said water nozzle consists of a single water nozzle, and wherein said air nozzle consists of a single air nozzle.

17. An assembly as recited in claim 13 wherein said guide means comprises a pair of guide rollers and a pair of belts of low friction material extending between said guide rollers, said belts straddling said water nozzle.

18. An assembly as recited in claim 13 further comprising heaters operatively connected to said air and water nozzles for heating the fluid delivered to said air and water nozzles.

19. An assembly as recited in claim 14 further comprising sensing means disposed within said housing and automatically operating said drive means, water spray nozzle, and air spray nozzle in response to the position of a cartridge within said housing.

20. An assembly as recited in claim 13 wherein said water and air nozzles each consist of a single nozzle.

21. A method of maintaining print cartridges of one of ion deposition and electron deposition imaging systems in a printer, wherein each of the cartridges have, a surface, using a cleaning system having a housing with an inlet, outlet, drive mechanism for driving a cartridge from the inlet to the outlet, a water nozzle supplied with water from a pump, an air nozzle, and sensors for sensing the position of the cartridge in the housing, said method comprising the steps of:

(a) every 10,000–30,000 feet of use of the print cartridge, removing the print cartridge from the printer and manually feeding the print cartridge into the housing inlet;

(b) automatically, responsive to the feeding step (a), sensing the penetration of the cartridge into the housing to a first position, and initiating operation of the water nozzle pump and the drive mechanism;

(c) after step (b), automatically driving the cartridge through the housing with the drive mechanism from the inlet toward the outlet in the drive path, while spraying the cartridge with water from the water nozzle;

(d) automatically sensing penetration of the cartridge to a second position within the housing, closer to the outlet than the first position, and then initiating operation of the air nozzle;

(e) after step (d), while the cartridge is being driven through the housing downstream of the water nozzle in the drive path, directing gas from the air nozzle onto the cartridge to dry the cartridge;

(f) automatically sensing penetration of the cartridge past the water nozzle so that the trailing end thereof stops operation of the pump while allowing the cartridge to continue to be driven through the system;

(g) after step (f), continuing to advance the cartridge while drying continues until the cartridge trailing end moves past a sensor close to the end of the housing at which time operations of the drive mechanism and the air nozzle are terminated;

(h) after step (g), manually withdrawing the print cartridge from the housing;

(i) performing steps (a) to (h) without contacting a center section of the surface of the cartridge with solid materials; and (j) after step (h) manually replacing the print cartridge in the printer.

22. A method as recited in claim 21 wherein step (c) is practiced to spray filtered water at a temperature between 120°–180° F. onto the cartridge, as a pressure of about 10–30 psi, directed in an angle of between about 30°–45° to the drive path, from a single nozzle disposed below the cartridge.

23. A method as recited in claim 21 wherein step (e) is practiced by directing filtered air at a temperature of between about 100°–140° F. at a pressure of about 10–30 psi onto the cartridge from a single nozzle disposed below the cartridge.

24. A method as recited in claim 21 wherein the cartridge has diagonal finger electrodes, and wherein step (c) is practiced to direct a fan pattern water spray onto the cartridge at a rate of between 0.5–2.0 gallons per minute, with the fan orthogonal to the diagonal finger electrodes.

25. A method as recited in claim 21 wherein steps (b) through (e) are practiced while driving the cartridge through the housing at a speed of about 9 inches per minute.

* * * * *